US010571847B2

(12) United States Patent
Miles et al.

(10) Patent No.: US 10,571,847 B2
(45) Date of Patent: Feb. 25, 2020

(54) STACKABLE COMPONENT ASSEMBLY

(71) Applicant: Hewlett-Packard Development Company, L.P., Houston, TX (US)

(72) Inventors: Michael D Miles, Vancouver, WA (US); Kevin Witkoe, Vancouver, WA (US); Jerrod Tyler, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,517

(22) PCT Filed: Jan. 29, 2016

(86) PCT No.: PCT/US2016/015625
§ 371 (c)(1),
(2) Date: Mar. 27, 2018

(87) PCT Pub. No.: WO2017/131737
PCT Pub. Date: Aug. 3, 2017

(65) Prior Publication Data
US 2018/0273314 A1 Sep. 27, 2018

(51) Int. Cl.
*G03G 15/00* (2006.01)
*B41J 13/10* (2006.01)

(52) U.S. Cl.
CPC ..... *G03G 15/6502* (2013.01); *B41J 13/103* (2013.01); *B65H 2402/10* (2013.01);
(Continued)

(58) Field of Classification Search
CPC ..... B65H 2402/10; B65H 2402/11; B65H 2402/61; B65H 2402/62; B65H 2402/63; B65H 2402/631; B65H 2402/632; B65H 2402/64; B65H 2405/10; B65H 2405/11; B65H 2405/111; B65H 2405/121; B65H 2405/14; B65H 2405/141; B65H 2405/30;
(Continued)

(56) References Cited

U.S. PATENT DOCUMENTS 4,410,099 A * 10/1983 deLarosiere ..... B65D 71/70 206/427
4,814,798 A 3/1989 Fukae et al.
(Continued)

FOREIGN PATENT DOCUMENTS

CN 104401568 A 3/2015
EP 0982233 3/2000

OTHER PUBLICATIONS

HP Support Center. HP Color LaserJet 5500 and 5550 Printer Series—First Time Setup and Installation ~ 0912912015 ~ 5 pages.

*Primary Examiner* — Jeremy R Severson
(74) *Attorney, Agent, or Firm* — Nathan Rieth

(57) ABSTRACT

In an example implementation, a stackable component assembly includes a first stackable component with a bottom recess in its bottom surface, and a second stackable component with a top recess in its top surface. A first alignment element is installed in the bottom recess and a second alignment element is installed in the top recess. The second alignment element is nestable within the first alignment element to align the first and second stackable components upon stacking the first stackable component onto the second stackable component.

10 Claims, 5 Drawing Sheets

(52) U.S. Cl.
CPC .... *B65H 2402/61* (2013.01); *B65H 2405/332* (2013.01); *G03G 2215/00734* (2013.01)

(58) Field of Classification Search
CPC ..... B65H 2405/31; B65H 2405/33; B65H 2405/332; B65H 2405/3321; B65H 2405/3322; B41J 29/026; B65D 71/70; B65D 21/0215; B65D 21/0209; B65D 21/023
See application file for complete search history.

(56) References Cited

U.S. PATENT DOCUMENTS

| | | | | |
|---|---|---|---|---|
| 5,803,631 | A | 9/1998 | Bingham et al. | |
| 7,243,915 | B2 | 7/2007 | Wong et al. | |
| 7,753,607 | B2 | 7/2010 | Tan et al. | |
| 8,393,606 | B2 * | 3/2013 | Wang | B65H 37/04 270/52.18 |
| 9,440,809 | B2 * | 9/2016 | Kuwata | B65H 1/04 |
| 9,567,133 | B2 * | 2/2017 | Josef | A61M 5/008 |
| 10,040,612 | B2 * | 8/2018 | Kuipers | A47B 87/0269 |
| 2003/0007321 | A1 | 1/2003 | Dayley | |
| 2004/0089618 | A1 | 5/2004 | Lauchner et al. | |
| 2014/0197065 | A1 | 7/2014 | Prince et al. | |
| 2015/0197106 | A1 | 7/2015 | Mackey et al. | |
| 2016/0344179 | A1 | 11/2016 | Huang et al. | |

* cited by examiner

STACKABLE COMPONENT ASSEMBLY

BACKGROUND

Many systems include multiple separate components that function together to produce a desired output. In some systems, stacking the separate components together can improve system functionality while reducing the amount of time, space, and cost associated with operating the system. Systems that frequently incorporate the use of separate, stackable components include, for example, audio/video systems, computer systems, printing systems, and so on.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
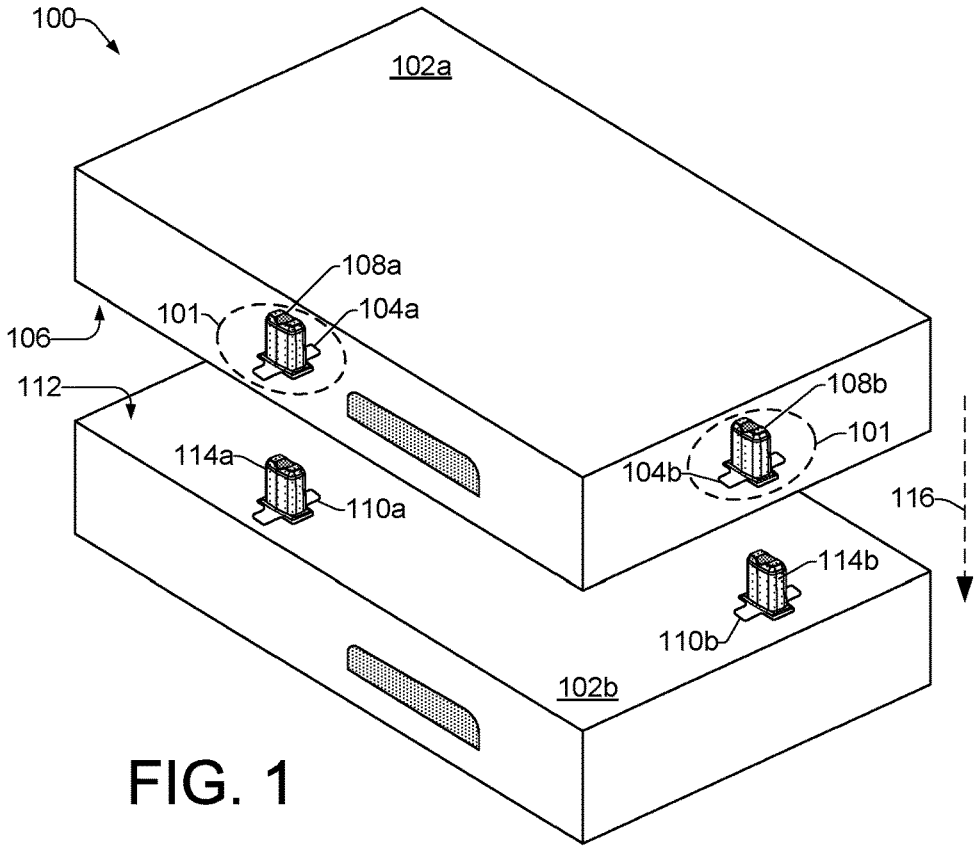
FIG. 1 shows a perspective view of an example stackable component assembly in which alignment elements are installed into two stackable components to enable stacking and alignment of the components.

Systems that incorporate multiple separate components can sometimes achieve improved functionality, along with smaller system footprint sizes and improved operating costs, when the separate components can be stacked together. Printing systems are one example of a system that can use multiple components. While printing systems may be used throughout parts of this description to illustrate various concepts, it is to be understood that such concepts may apply similarly to other types of systems implementing multiple, and potentially stackable components.

Printing systems (printers) often provide the convenience of having different types of printable media that can be automatically selected based on a desired printed output. Such printers can have a media input tray system that includes multiple media trays to accommodate the different types and sizes of media. For example, a printer can have a first media tray to be loaded with letter-sized plain paper, a second media tray to be loaded with legal-sized plain paper, and a third media tray to be loaded with postcard-sized photo paper. The printer can then automatically engage either media tray in order to access the appropriate type of media depending on whether a user is printing a plain paper document or a photograph.

In some examples, multiple or auxiliary media trays can be stacked underneath the printer to enable the printer to pull media from any of the media trays. When media trays are stacked, each tray can have a unique electronic identity assigned by the printer. In addition, in some printing systems there may be particular media trays that are to be located in specific locations within the stack of media trays. Thus, for the convenience and reliability of putting the stack of media trays together, it is useful to have unique interface features that indicate a predetermined stacking order and help to prevent stacking the media trays in an incorrect order.

One method often used by printer manufacturers to help maintain a proper sequence of media trays is to apply creative symbology, or alphanumeric identifiers (letters, numbers, or letters and numbers) to each tray. Such nomenclature has an implied order or sequence for installing the trays that the user is to follow in order for the system to be configured correctly. While this method can work well, it does not account for inadvertent user errors. Other manufacturers apply unique mechanical features to physically key each element of the stack (i.e., the media trays and the printer). Although this type of mechanical keying system is generally quite successful, it involves the use of unique chassis or housing features for each of the stack elements, which can create additional overhead in handling and storage of otherwise identical subsystems.

Accordingly, examples presented herein of a stackable component assembly enable the precision stacking of multiple stackable components in a predetermined order through installation into the components of a single alignment element at multiple locations and in multiple orientations. An alignment element installed into the top of one stackable component (e.g., a print media tray) in a particular location and orientation can align and nest closely with an alignment element installed into the bottom of another stackable component in a corresponding location and same orientation. The close alignment of the two elements is enabled by the insertion or nesting of a closed end of one element into the open end of the other element when the stackable components are brought together. Because the two alignment elements are installed in the same orientation and corresponding locations on the stackable components, the stackable components are permitted to be stacked together by the nesting of the alignment elements. When alignment elements are installed in different orientations and or locations on stackable components, the stackable components are not intended to be stacked together and the alignment elements will prevent stacking because they cannot nest together.

The ability to install a single alignment element in multiple orientations and locations on stackable components permits each stackable component to be manufactured without unique chassis or housing features. Stackable components can be produced economically as identical throughout most of the manufacturing process, and their positional identity within the stack can be assigned at the end of the production line. This reduces the number of unique parts and product versions being manufactured, assembled, and stored, and it increases the flexibility in reconfiguring products in the field during service and replacement.

In one example implementation, a stackable component assembly includes a first stackable component with a bottom recess in its bottom surface, and a second stackable component with a top recess in its top surface. A first alignment element is installed in the bottom recess and a second alignment element is installed in the top recess. The second alignment element is nestable within the first alignment element to align the first and second stackable components upon stacking the first stackable component onto the second stackable component.

In another example implementation, a stackable component assembly includes multiple stackable components stacked in a specific order controlled by alignment elements that are installed in the stackable components. Each stackable component includes an alignment element installed in an orientation and a location that enables nesting with another alignment element of the same orientation and relative location installed in another stackable component.

In another example implementation, a stackable component assembly includes first and second stackable components and a set of alignment elements to enable a stacking order of the first and second stackable components. The set of alignment elements include a first alignment element installed in the first stackable component at a first location and in a first orientation, and a second alignment element installed in the second stackable component at the first location and in the first orientation. The second alignment element is nested within the first alignment element.

FIG. 1 shows a perspective view of an example stackable component assembly 100 in which alignment elements are installed into two stackable components to enable stacking and alignment of the components. In some examples, the stackable components can include printing system components such as stackable media trays and a printing device. As shown in FIG. 1 through a cutout view 101 (dashed oval lines), a first stackable component 102*a* includes bottom recesses 104 (illustrated as 104*a* and 104*b*) in its bottom surface 106. The bottom recesses 104 each comprise a hole or cavity in the bottom surface 106 of the first stackable component 102*a* into which an alignment element 108 (illustrated as 108*a* and 108*b*) can be installed.

A second stackable component 102*b* of FIG. 1 includes top recesses 110 (illustrated as 110*a* and 110*b*) in its top surface 112. The top recesses 110 comprise a hole or cavity in the top surface 112 of the second stackable component 102*b* into which alignment elements 114 (illustrated as 114*a* and 114*b*) can be installed. The locations of the top recesses 110 and alignment elements 114 in the top surface 112 correspond with the locations of the bottom recesses 104 and alignment elements 108 in the bottom surface 106. More specifically, alignment elements 108*a* and 108*b* are located in the bottom surface 106 directly over alignment elements 114*a* and 114*b* in the top surface 112 such that elements 108*a* and 114*a* form a set, and elements 108*b* and 114*b* form a set. This correspondence in the locations of the alignment elements between the bottom and top surfaces of the first and second stackable components 102*a*, 102*b*, enables stacking of the first and second stackable components 102*a*, 102*b*. By contrast, in the case where two stackable components have similarly configured alignment elements that are not in corresponding locations between the component surfaces, stacking of two such components will be prevented or locked out by the alignment elements. In general, as discussed in more detail below, the first and second stackable components 102*a*, 102*b*, can be aligned and stacked together through the nesting of alignment elements 114*a* and 114*b* into alignment elements 108*a* and 108*b*, respectively, which can occur as the first and second stackable components 102*a* and 102*b* are brought together as indicated by dashed arrow 116.

Figure 2:
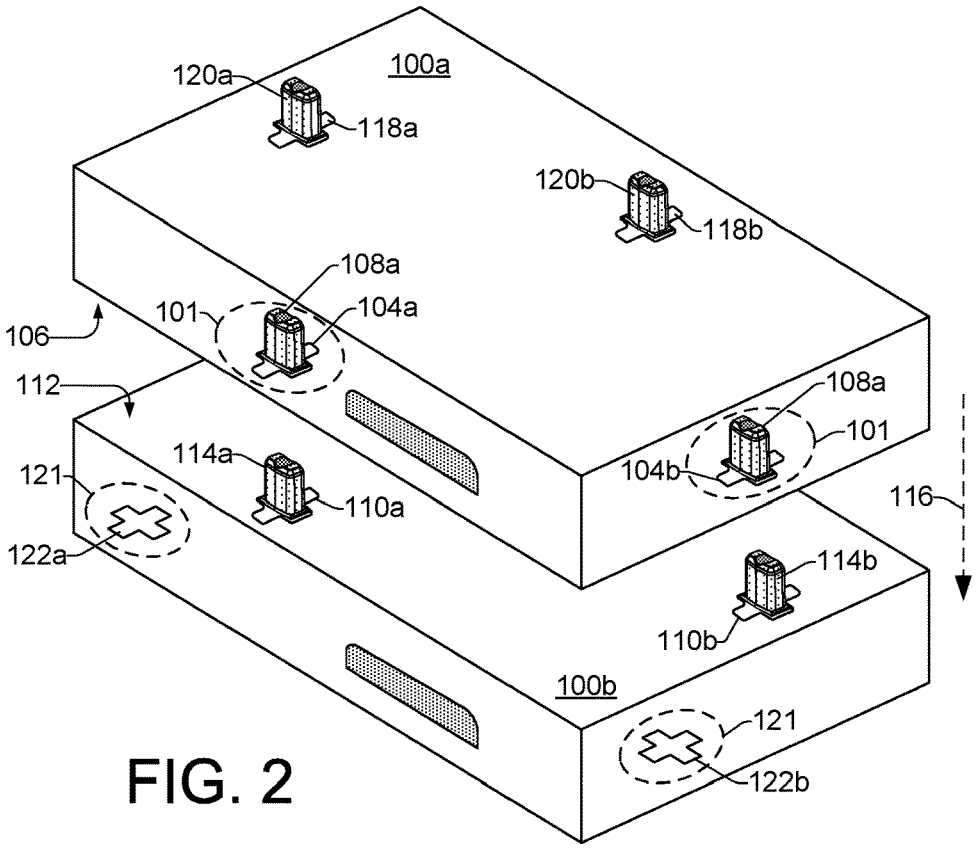
FIG. 2 shows a perspective view of an example stackable component assembly in which a first stackable component includes alignment elements installed into its top surface.

FIG. 2 shows a perspective view of an example stackable component assembly 100 as in FIG. 1 in which the first stackable component 102*a* includes additional alignment elements installed into its top surface to enable a third stackable component (not shown) to be stacked on top of it. In some examples, a third stackable component can include a printing system component such as a stackable media tray or a printing device. As shown in FIG. 2, the first stackable component 102*a* includes top recesses 118 (illustrated as 118*a* and 118*b*) into which the additional alignment elements 120 (illustrated as 120*a* and 120*b*) are installed. In some examples, a third stackable component can be aligned with and stacked onto the first stackable component 102*a* when alignment elements 120*a* and 120*b* are nested into corresponding alignment elements (not shown) of a third stackable component. Also shown in FIG. 2 through a cutout view 121 (dashed oval lines), are bottom recesses 122*a* and 122*b*. The bottom recesses 122*a* and 122*b* illustrate locations into which additional alignment elements can be installed to enable yet another stackable component to be aligned with and stacked with stackable components 102*a* and 102*b*. In general, the illustration in FIG. 2 is to indicate in part, how numerous stackable components can be stacked using alignment elements installed in multiple corresponding locations within the surfaces of the components.

Figure 3:
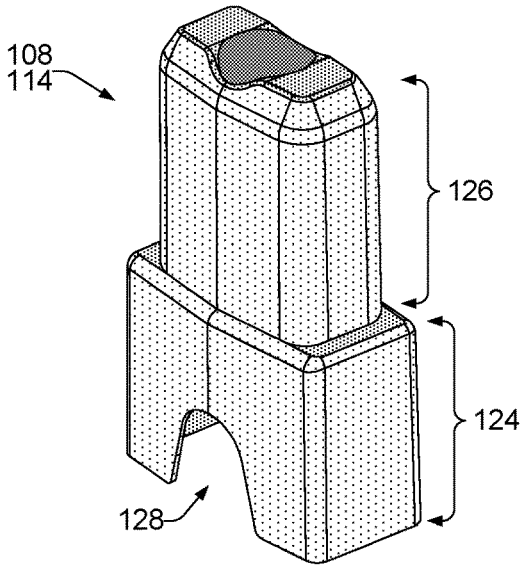
FIG. 3 shows a perspective view of an example of an alignment element.
Figure 4:
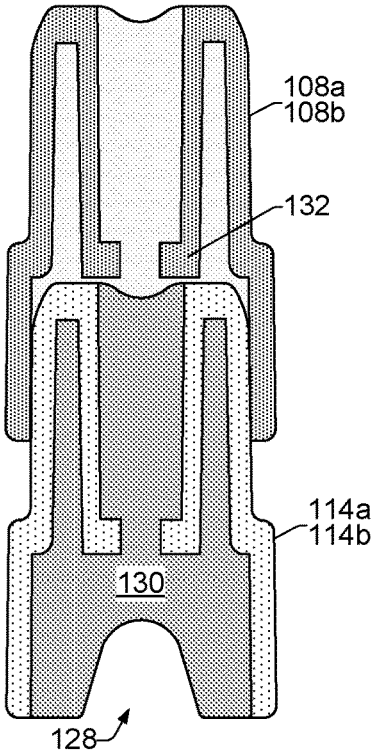
FIG. 4 shows a cross-sectional view of two example alignment elements in which one alignment element is nested within the other alignment element.

FIG. 3 shows a perspective view of an example of an alignment element (e.g., 108, 114). FIG. 4 shows a cross-sectional view of two example alignment elements in which one alignment element is nested within the other alignment element. In general, the alignment elements discussed and illustrated herein are identical to one another. Thus, each of the alignment elements 108*a*, 108*b*, 114*a*, 114*b*, has the same size, shape, and characteristics as the others. While one particular type of alignment element is shown and described, it is noted that other alignment elements are contemplated that can perform the same general function of installation within the surface of a stackable component and nesting within other like alignment elements.

Figure 5:
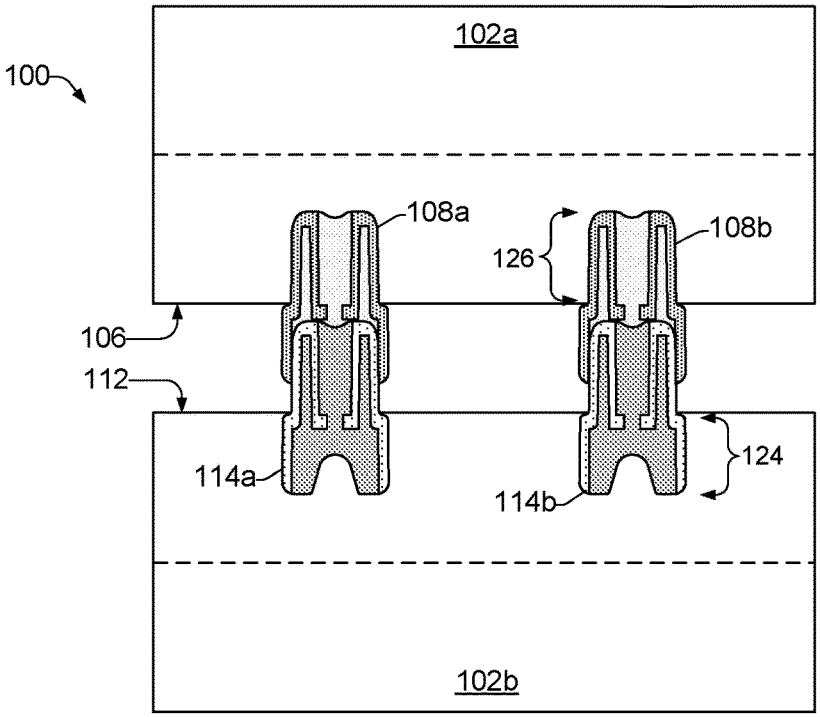
FIG. 5 shows an example of a stackable component assembly with a cross-sectional view of example sets of alignment elements installed at two locations into the surfaces of stackable components.

Referring now primarily to FIGS. 3 and 4, the example alignment element 108, 114, has a tapered shape that tapers from a broad end 124 to a narrow end 126. In some examples, the broad end 124 of an alignment element can be referred to as a first part 124 of the alignment element, while the narrow end 126 of the alignment element can be referred to as the second part 126 of the alignment element. Each example alignment element comprises a broad opening 128 at the broad end 124 and a hollow internal cavity 130 to receive the narrow end 126 of another alignment element to enable the insertion and nesting of one alignment element within another. Two alignment elements can form a set when they are installed into stackable component surfaces at corresponding locations and orientations that enable them to nest together when the stackable components are stacked. For example, as shown in FIGS. 4 and 5, alignment elements 114 (114*a*, 114*b*) are nested within the alignment elements 108 (108*a*, 108*b*), forming sets of alignment elements. The narrow end 126 of element 114 fits very closely into the broad end 124 of element 108. Each alignment element comprises an internal insertion stop 132 to limit how far other alignment elements can be inserted into the hollow cavity 130.

FIG. 5 shows an example representation of a stackable component assembly 100 with a cross-sectional view of example sets of alignment elements installed at two locations into the surfaces of stackable components. The broad end 124, or first part 124, of an alignment element 114 (114*a*, 114*b*) is installed in or recessed into the top surface 112 of a stackable component 102*b*, leaving the narrow end 126 or second part 126 of the alignment element 114 protruding out from the top surface 112. The narrow end 126, or second part 126, of an alignment element 108 (108*a*, 108*b*) is installed or recessed into the bottom surface 106 of a stackable component 102*a*, leaving the broad end 124 or first part 124 protruding out from the bottom surface 106. The successful stacking of the first stackable component 102*a* onto the second stackable component 102*b* depends in part on the alignment elements 114*a* and 114*b* being installed at locations on the second component surface 112 that correspond respectively with locations of the alignment elements 108*a* and 108*b* on the first component surface 106. If either alignment element 114*a* or 114*b* is installed at a location that does not correspond with the respective locations of alignment elements 108*a* and 108*b*, then the first component 102*a* will be prevented or locked out from stacking onto the second component 102*b*.

The successful stacking of the first component 102*a* onto the second component 102*b* additionally depends on the orientations of the alignment elements 114*a* and 114*b* installed into surface 112 relative to the orientations of alignment elements 108*a* and 108*b* installed into surface 106. When both alignment elements 114*a* and 108*a* have the same orientations and corresponding locations, they form a set 114*a*/108*a* that can nest together to enable stacking of the first component 102*a* onto the second component 102*b*. Conversely, if elements 114*a* and 108*a* do not have the same orientations or corresponding locations, they will not form a set and they will prevent or lock out the first component 102*a* from stacking onto the second component 102*b*. Likewise, when both alignment elements 114*b* and 108*b* have the same orientations and corresponding locations, they form a set 114*b*/108*b* that can nest together to enable stacking of the first component 102*a* onto the second component 102*b*. However, if elements 114*b* and 108*b* do not have the same orientations or corresponding locations, they will not form a set and they will prevent or lock out the first component 102*a* from stacking onto the second component 102*b*.

Figure 6:
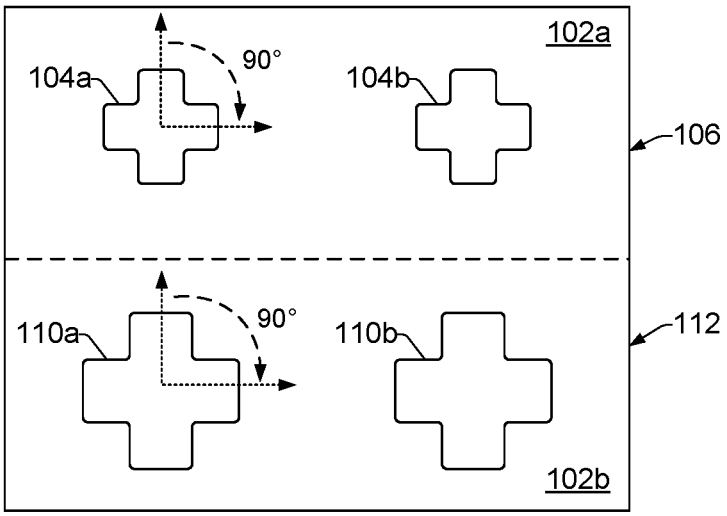
FIG. 6 shows examples of recesses in the surfaces of stackable components.

FIG. 6 shows examples of recesses in the surfaces of stackable components. As noted above, a recess comprises a hole or cavity formed in the surface of a stackable component into which an alignment element can be installed in different orientations. FIG. 6 illustrates examples of top recesses, such as top recesses 110 (110*a*, 110*b*) in the top surface 112 of stackable component 102*b* of FIG. 1, and examples of bottom recesses, such as bottom recesses 104 (104*a*, 104*b*) in the bottom surface 106 of the stackable component 102*a* of FIG. 1. To accommodate the tapered shape of an alignment element installed into the recesses, the top recesses 110 can be smaller in size than the bottom recesses 104. This is because, as shown above in FIG. 5, the narrow ends 126 of alignment elements are installed into the bottom surface 106 of a stackable component 102*a*, and the broad ends 124 of alignment elements are installed into the top surface 112 of a stackable component 102*b*.

Figure 7:
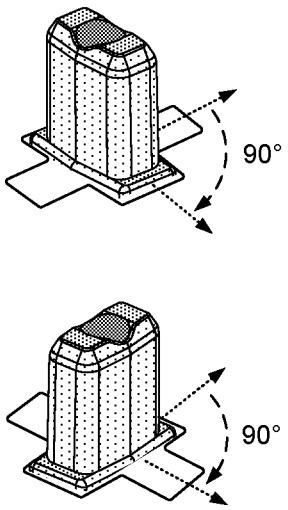
FIG. 7 shows examples of alignment elements installed within recesses in two different orientations.

FIG. 7 shows examples of alignment elements installed within recesses in two different orientations. Referring to FIGS. 6 and 7, the recesses comprise orientation features or shapes that enable the installation of the alignment elements in the two different orientations. More specifically, as shown in FIGS. 6 and 7, the two different orientations comprise first and second orientations that are rotationally offset from one another by a 90 degree offset.

Figure 8:
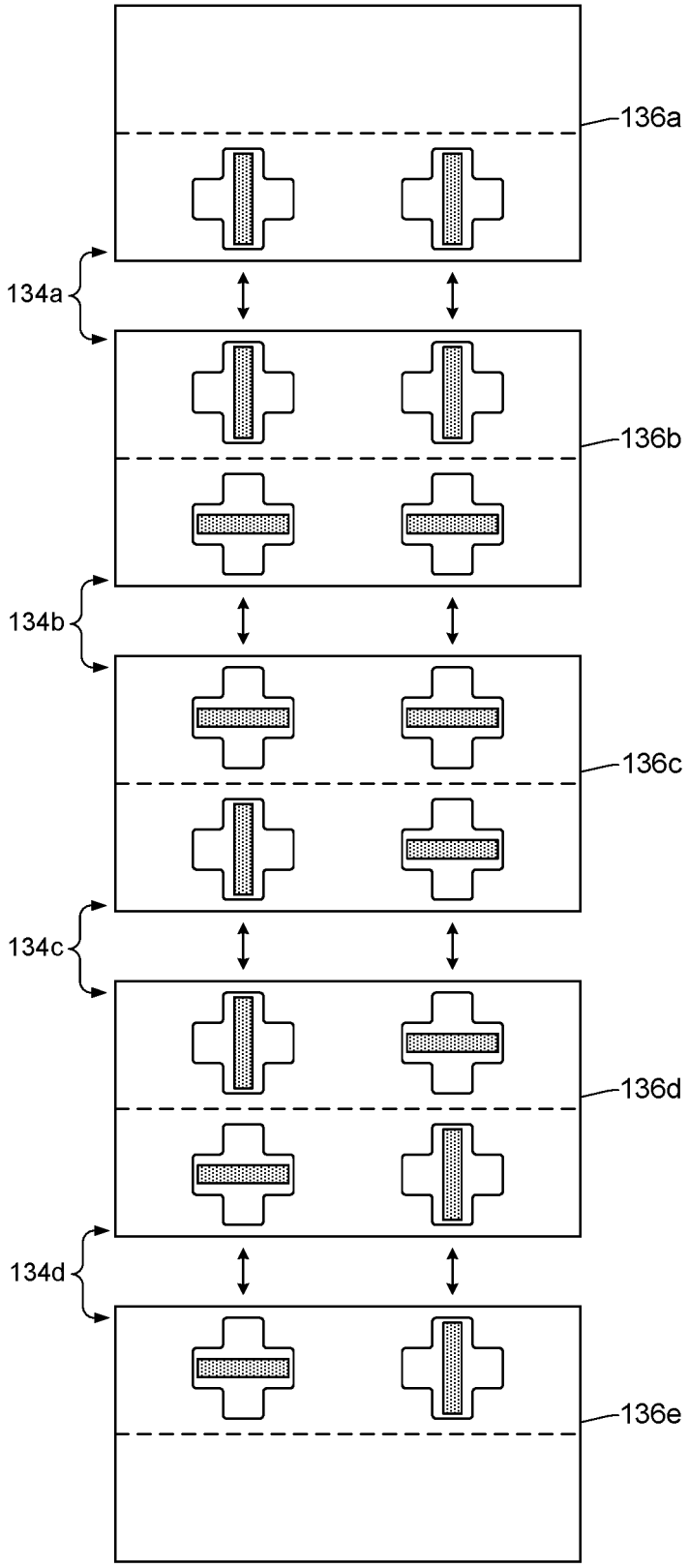
FIG. 8 shows examples of different orientation combinations that can be implemented using example recesses in which two possible orientations are available at each of the two locations on the surfaces of stackable components.

FIG. 8 shows the different orientation combinations that can be implemented using the example recesses in which two possible orientations are available at each of the two locations on the surfaces of the stackable components. The two possible orientations at each of the two locations result in four different and unique orientation combinations 134 (illustrated as 134*a*, 134*b*, 134*c*, 134*d*) between the top and bottom surfaces of stackable components, which enables up to five stackable components 136 (illustrated as 136*a*, 136*b*, 136*c*, 136*d*, 136*e*) to be stacked in a predefined, unique order. In some examples, the stackable components 136 can comprise printing system components such as a printing device and print media trays.

Figure 9:
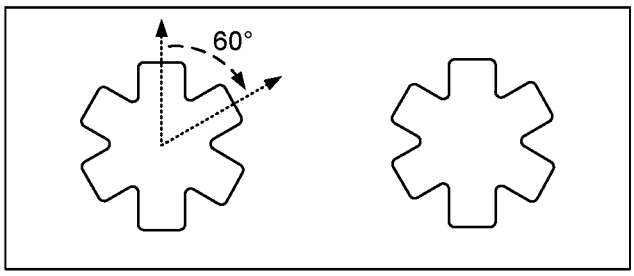
FIG. 9 shows examples of recesses in the surfaces of stackable components in which three different rotational orientations are possible for each recess location.

In other examples, alignment elements can be installed in recesses enabling more than two different orientations for each recess location. FIG. 9 shows examples of recesses in the surfaces of stackable components in which three different rotational orientations are possible for each recess location. As shown in FIG. 9, the three different orientations would comprise first, second, and third orientations that are rotationally offset from one another by a 60 degree offset. The example in FIG. 9 of three different orientations at two different locations enables a greater number of stackable components to be stacked in a unique order. Other combinations of numbers of different orientations and different installable locations are also contemplated.

Figure 10:
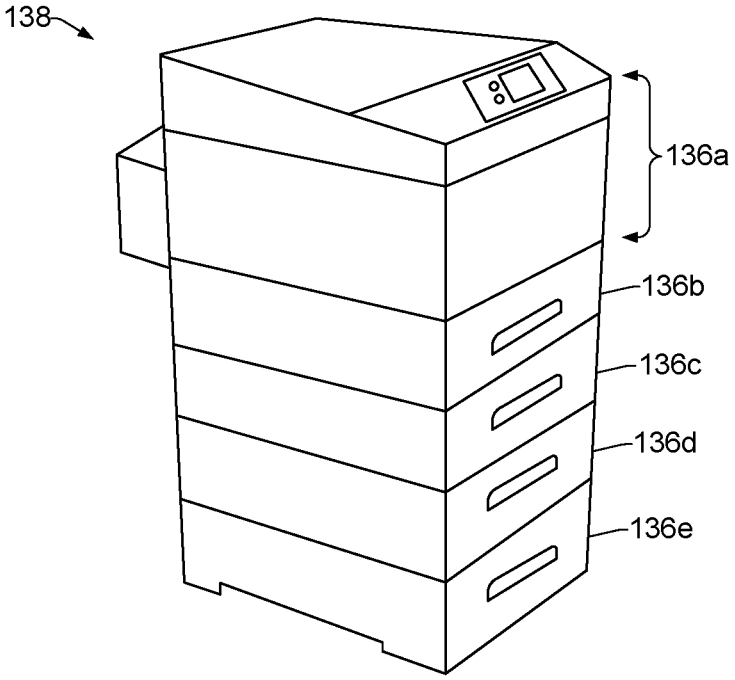
FIG. 10 shows an example of a printing system suitable for implementing an example stackable component assembly.

FIG. 10 shows an example of a printing system 138 that is suitable for implementing a stackable component assembly 100 in which alignment elements can be installed in two possible orientations at each of two locations on the top and bottom surfaces of the stackable components. As noted above with regard to FIG. 8, this combination of orientations and locations enables up to five stackable components 136 to be stacked in a predefined, unique order. In the example printing system 138, the stackable components can include the printing device 136*a* stacked on top of a predefined order of media paper trays, 136*b*, 136*c*, 136*d*, and 136*e*.

What is claimed is:

1. A stackable component assembly comprising:

a first stackable component with a bottom recess in its bottom surface;

a second stackable component with a top recess in its top surface;

a first alignment element installed in the bottom recess; and, a second alignment element installed in the top recess and nestable within the first alignment element to align the first and second stackable components upon stacking the first stackable component onto the second stackable component.

2. A stackable component assembly as in claim 1, wherein the bottom recess and top recess each comprise orientation features to enable, respectively, the first alignment element and second alignment element to be installed in multiple orientations.

3. A stackable component assembly as in claim 2, wherein the second alignment element is nestable within the first alignment element when the first and second alignment elements are installed in a same orientation, and the second alignment element is not nestable within the first alignment element when the first and second alignment elements are installed in a different orientation.

4. A stackable component assembly as in claim 2, wherein the multiple orientations comprise a first orientation and a second orientation that are offset 90 degrees from one another.

5. A stackable component assembly as in claim 1, wherein:

the bottom recess comprises multiple bottom recesses at different locations in the bottom surface, each bottom recess having a first alignment element installed therein; and, the top recess comprises multiple top recesses in the top surface at corresponding locations to the multiple bottom recesses, each top recess having a second alignment element installed therein that is nestable with a first alignment element at a corresponding location.

6. A stackable component assembly as in claim 1, wherein the first stackable component comprises:

a third alignment element installed in its top surface to nest within a fourth alignment element of a third stackable component upon stacking the third stackable component onto the first stackable component.

7. A stackable component assembly as in claim 1, wherein the first and second alignment elements are identical elements that are interchangeable with one another.

8. A stackable component assembly as in claim 7, wherein the first alignment element comprises:

a tapered shape that tapers, from a broad end to a narrow end;

a hollow cavity to receive the narrow end of the second alignment element to nest the first and second alignment elements; and, an insertion stop to limit insertion of the second alignment element into the hollow cavity.

9. A stackable component assembly as in claim 1, wherein the stackable components comprise printing system components selected from the group consisting of a printer component and a paper tray component.

10. A stackable component assembly as in claim 1, wherein the stackable components comprise a paper tray component, the paper tray component comprising:

a paper ray housing into which the first and second alignment elements are installed; and a paper tray cassette removable from the paper tray housing.

* * * * *